United States Patent [19]

Aizawa et al.

[11] 4,083,185

[45] Apr. 11, 1978

[54] SHIELDING ARRANGEMENT FOR EXHAUST PURIFIER

[75] Inventors: Hideo Aizawa, Yokosuka; Makoto Moriya, Tokyo, both of Japan

[73] Assignee: Nissan Motor Company, Limited, Japan

[21] Appl. No.: 692,383

[22] Filed: Jun. 3, 1976

[30] Foreign Application Priority Data

Jun. 24, 1975 Japan ..... 50-87529[U]

[51] Int. Cl.[2] ..... F01N 3/08

[52] U.S. Cl. ..... 60/299; 23/288 F

[58] Field of Search ..... 60/299; 23/288 F; 180/64 A; 181/72

[56] References Cited

U.S. PATENT DOCUMENTS

| | | | |
|---|---|---|---|
| 3,154,387 | 10/1964 | Wright | 60/299 X |
| 3,677,364 | 7/1972 | Pawling | 181/72 X |
| 3,852,041 | 12/1974 | Moore et al. | 23/288 F |
| 3,863,445 | 2/1975 | Heath | 60/299 |
| 3,963,087 | 6/1976 | Grosseau | 60/299 X |

*Primary Examiner*—Carlton R. Croyle
*Assistant Examiner*—Michael Koczo, Jr.
*Attorney, Agent, or Firm*—Lowe, King, Price & Markva

[57] ABSTRACT

A shield member has a channel which receives therein an exhaust purifier and is formed with at least one hole in that region on the bottom wall of the channel which is not disposed under the exhaust purifier.

3 Claims, 2 Drawing Figures

SHIELDING ARRANGEMENT FOR EXHAUST PURIFIER

The present invention relates to an automobile and more particularly to a shielding arrangement for an exhaust purifier disposed under a vehicle body.

Some of the automobiles are provided with an exhaust purifier, such as a catalytic converter or a thermal reactor, in an exhaust system disposed under a vehicle body. Due to the exhaust purifier, the temperature of the exhaust system rises considerably and thus there is a possibility that the combustible things on the road may burn if they come in contact with the exhaust purifier. To eliminate this it is known to provide the exhaust purifier with a shield member. The conventional shield member has a bottom wall with side walls to form a channel and is attached to the exhaust purifier in such a manner that the channel receives therein the exhaust purifier. This shielding arrangement has a drawback that small stones, dust, mud and water enter the channel through a spacing between each of the side walls and the exhaust purifier and they are unremovable from the channel and cause a noise during running of automobile.

The present invention solves the drawback by forming a hole in the region on the bottom wall of a shield member which is not disposed under an exhaust purifier received in the channel of the shield member.

It is a primary object of the present invention to provide a shielding arrangement which allows easy removable of any matter which have entered a channel of a shield member in which an exhaust purifier is received.

It is another object of the present invention to provide a shield member formed with a hole through which any matters which have entered between the bottom wall of the shield member and the exhaust purifier are removed.

Figure 1:
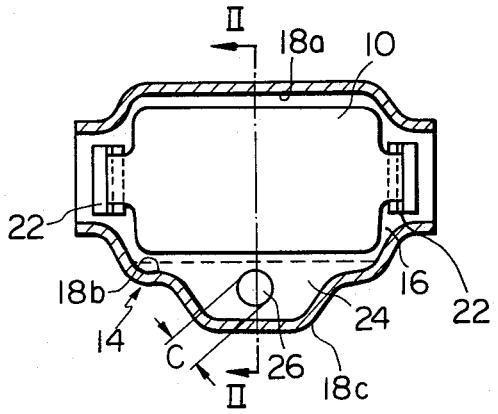
Figure 2:
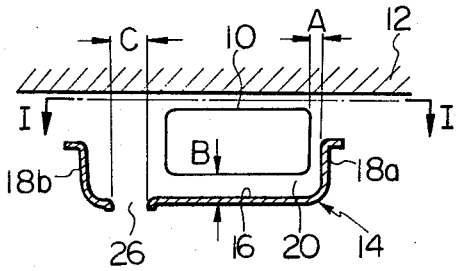

Other objects and advantages of the present invention will become apparent from the following description in connection with the accompanying drawings, in which:

FIG. 1 is an elevation of an exhaust purifier and a shield member according to the present invention as viewed along the arrows I shown in FIG. 2; and FIG. 2 is a section taken through line II—II shown in FIG. 1.

Referring to the drawings, there is shown an exhaust purifier 10, such as a catalytic converter or a thermal reactor, of an exhaust system of an automobile. The exhaust purifier 10 is disposed under a vehicle body 12 (see FIG. 2) of the automobile. A shield member 14 has a bottom wall 16 and two side walls **18*a* and 18*b* to form a channel 20. The shield member 14 has a bracket 22 at each of the ends of the channel 20 and is attached to the exhaust purifier 10 by means of the brackets 22 in such a manner that the channel 20 receives therein the exhaust purifier 10. One of the side walls 18*a* is spaced from the exhaust purifier 10 by at most a distance A (see FIG. 2), the bottom wall 16 is spaced from the exhaust purifier 10 by at least a distance B which is greater than the distance A and the bottom wall 16 has an area coextending with the exhaust purifier 10 and a second area 24 disposed outside of the first area. The second area is formed with at least one hole, only one being shown at 26. The other side wall 18*b* has a protruding portion 18*c* extending upward from the edge of the second area 24. The hole 26 has a diameter C that is greater than the distance A so that small stones which have entered a space between the channel 20 and the exhaust purifier 10 through a space between the side wall 18*a* and exhaust purifier 10 are removed through the hole 26. It is to be noted that providing the hole 26 within the second area 24 which is not disposed under the exhaust purifier 10 will prevent combustible things from contacting with the exhaust purifier 10**.

From the preceding it will now be appreciated that according to the present invention a shield member can allow easy removable of any matters which have entered the channel thereof without disassemble and prevent combustible things from contacting with the exhaust purifier.

What is claimed is:

1. In an automobile having an exhaust purifier in its exhaust system, said exhaust purifier being disposed under the vehicle body of the automobile, the combination with said exhaust purifier of a shield member and means for supporting said shield member spaced apart from said exhaust purifier, said shield member having a channel receiving therein said exhaust purifier, a bottom wall and two side walls, said bottom wall and said side walls cooperating to form said channel, said bottom wall having an area coextending with said exhaust purifier and a second area disposed adjacent said first mentioned area, said second area being formed with at least one hole which is big enough to allow removal of any matters that have entered the space between said exhaust purifier and said bottom wall.

2. The combination of claim 1, wherein said supporting means includes means for attaching said exhaust purifier to said shield member with a body portion of said exhaust purifier spaced apart from said shield member.

3. The combination of claim 1, wherein one of said side walls is spaced apart from said exhaust purifier by a distance less than the diameter of the hole formed in said second area.

* * * * *